US012788133B2

(12) United States Patent
Schiffer

(10) Patent No.: US 12,788,133 B2
(45) Date of Patent: Nov. 10, 2026

(54) CLEANING DEVICE FOR ORAL HYGIENE AND METHOD FOR MANUFACTURING A CLEANING DEVICE FOR ORAL HYGIENE

(71) Applicant: M+C Schiffer GmbH, Neustadt/Wied (DE)

(72) Inventor: Küros Schiffer, Neustadt-Wied (DE)

(73) Assignee: M+C Schiffer GmbH, Neustadt/Wied (DE)

( * ) Notice: Subject to any disclaimer, the term of this patent is extended or adjusted under 35 U.S.C. 154(b) by 291 days.

(21) Appl. No.: 18/255,591

(22) PCT Filed: Dec. 2, 2021

(86) PCT No.: PCT/EP2021/083912
§ 371 (c)(1),
(2) Date: Jun. 2, 2023

(87) PCT Pub. No.: WO2022/117705
PCT Pub. Date: Jun. 9, 2022

(65) Prior Publication Data

US 2024/0008633 A1 Jan. 11, 2024

(30) Foreign Application Priority Data

Dec. 3, 2020 (DE) ..... 10 2020 132 142.2

(51) Int. Cl.
*A46B 9/04* (2006.01)

(52) U.S. Cl.
CPC ..... *A46B 9/04* (2013.01); *A46B 2200/108* (2013.01)

(58) Field of Classification Search
CPC .... A46B 9/04; A46B 3/00; A46B 3/04; A46D 3/00
See application file for complete search history.

(56) References Cited

U.S. PATENT DOCUMENTS

| | | | | |
|---|---|---|---|---|
| 5,010,906 | A * | 4/1991 | Preciutti | A61C 15/00 601/139 |
| 5,121,520 | A * | 6/1992 | Brice | A46B 5/0066 15/167.1 |
| 2003/0088931 | A1* | 5/2003 | Russell | B29C 66/83221 156/304.6 |
| 2015/0097309 | A1 | 4/2015 | Newman et al. | |
| 2016/0058531 | A1 | 3/2016 | Adriano et al. | |
| 2019/0000598 | A1 | 1/2019 | Kikkawa et al. | |

FOREIGN PATENT DOCUMENTS

| | | | | |
|---|---|---|---|---|
| AU | 2007314135 | B2 | 5/2008 | |
| CN | 107928092 | A * | 4/2018 | A46B 5/0095 |
| CN | 108102325 | A * | 6/2018 | C08H 8/00 |
| CN | 119095523 | A * | 12/2024 | B26B 21/522 |
| EP | 0631742 | A1 * | 1/1995 | A46B 11/063 |
| EP | 1110478 | A1 | 6/2001 | |
| EP | 3117797 | A1 | 1/2017 | |
| EP | 3569190 | A1 | 11/2019 | |
| JP | H856966 | A | 3/1996 | |
| JP | 2019118798 | A | 7/2019 | |
| TW | M618158 | U | 10/2021 | |
| WO | 2020193760 | A1 | 10/2020 | |

* cited by examiner

*Primary Examiner* — Shay Karls
(74) *Attorney, Agent, or Firm* — The Webb Law Firm

(57) ABSTRACT

The invention relates to a cleaning device for oral hygiene including a cleaning element and a handle element connected to the cleaning element. The cleaning device is characterized in that the handle element is made of an injection molded fiber material. The invention further relates to a method of manufacturing a cleaning device for oral hygiene. The method includes providing a cleaning element, manufacturing a handle element by injection molding a fiber material, and connecting the handle element to the cleaning element.

10 Claims, No Drawings

CLEANING DEVICE FOR ORAL HYGIENE AND METHOD FOR MANUFACTURING A CLEANING DEVICE FOR ORAL HYGIENE

CROSS-REFERENCE TO RELATED APPLICATIONS

This application is the United States national phase of International Application No. PCT/EP2021/083912 filed Dec. 2, 2021, and claims priority to German Patent Application No. 10 2020 132 142.2 filed Dec. 3, 2020, the disclosures of each of which are hereby incorporated by reference in their entireties.

BACKGROUND OF THE INVENTION

Field of the Invention

The invention relates to a cleaning device for oral hygiene, in particular a toothbrush, an interdental cleaning device or a dental floss holder, and a method for manufacturing the cleaning device.

Description of Related Art

The invention relates to cleaning devices for personal oral hygiene, for example toothbrushes, rod-shaped interdental cleaning devices or dental floss holders. Such cleaning devices are usually made predominantly of injection-molded plastic.

EP 1110478 A1 discloses, for example, a method for manufacturing a toothbrush by injection molding of plastic. EP 3569190 A1 discloses interdental cleaning devices made of thermoplastic material. EP 3117797 A1 discloses a dental floss holder.

Production from injection-molded plastic has the advantage that the cleaning equipment can be manufactured in large quantities and with consistent quality. In addition, the use of plastic makes production cost-effective. However, the use of plastic is increasingly fraught with problems in terms of environmental protection. Plastic is largely obtained from fossil raw materials, and its production thus contributes to carbon dioxide emissions. In addition, very few plastics are biodegradable, so that the disposal of plastic products leads to considerable environmental pollution.

There is therefore an interest in reducing the amount of plastic used. From WO 2020/193760 A1, the use of foamed plastic is known for this purpose. The foamed plastic partially replaces the solid plastic otherwise used, thus reducing the overall amount of plastic while maintaining the stability of the cleaning device. However, even with this solution, the cleaning device is formed almost entirely from non-biodegradable material.

SUMMARY OF THE INVENTION

The object of the present invention is to provide a cleaning device for oral hygiene, in particular a toothbrush, an interdental cleaning device or a dental floss holder, which consists predominantly of renewable, easily recyclable and environmentally friendly raw materials. Furthermore, the cleaning device should have sufficient durability for daily use. It is further the object of the present invention to provide a method of manufacturing such a cleaning device, by which the cleaning device can be manufactured inexpensively, in large numbers and in high quality.

These tasks are solved by the oral hygiene cleaning device and the method for manufacturing an oral hygiene cleaning device according to the present invention.

The invention provides a cleaning device for oral hygiene. The cleaning device comprises a cleaning element and a handle element connected to the cleaning element. The cleaning device is characterized in that the handle element is made of an injection molded fiber material.

The invention further provides a method of manufacturing an oral hygiene cleaning device. The method comprises the steps of: providing a cleaning element, manufacturing or producing a handle element by injection molding a fiber material, and joining the handle element to the cleaning element.

An essential element of the invention is the production of the handle element by injection molding of a fiber material. Fiber material consists of renewable raw materials, for example wood fiber, and is thus easily compostable or recyclable. By making the handle element from this environmentally friendly material, the amount of less environmentally friendly plastic used can be significantly reduced compared to conventional cleaning devices. A cleaning device can thus be provided in which plastic is only used to form the actual cleaning element, for example the brush head of a toothbrush or the tip of an interdental cleaning device. The handle element and thus by far the largest part of the cleaning device, on the other hand, can be formed from a fiber material.

Another advantage of the invention is that the durability of the handle element is increased by processing the fiber material by injection molding. By means of injection molding, it is possible to produce molded parts with excellent mechanical properties from the fiber material. More stable molded parts can thus be produced than with other processing methods commonly used for fiber materials.

In addition, processing by means of injection molding facilitates shaping, so that molded parts with the desired shape, for example ergonomically shaped toothbrush handles, can be produced without major effort. The handle element can be manufactured using injection molding machines, which ensure high throughput and consistent product quality. This distinguishes processing by injection molding from other methods of processing fiber materials. For example, in the production of cardboard, a suspension of the fiber material must first be spread out on screens, dried and pressed into sheets before the cardboard can then be formed into moldings by cutting and rolling the sheets. With injection molding, on the other hand, the suspension of fiber material can be formed into the desired shape in a single process step.

Individual features of the invention are explained in more detail below.

The cleaning device is in particular a device for personal oral hygiene, for example a toothbrush, a rod-shaped interdental cleaning device or a dental floss holder. Such a cleaning device usually has a handle with which the cleaning device can be guided in one hand.

The handle of the cleaning device is formed entirely or partially from the handle element. In one embodiment, the handle is formed entirely from the material of the handle element. The otherwise customary use of plastic for the manufacture of a handle can thus be dispensed with. However, it is also possible for the handle to have a core made of a material other than the fiber material of the handle element. For example, the core of the handle can be made of an injection-molded plastic, which is sheathed by the fiber material to form the handle element. In this case, the fiber material replaces the otherwise customary overmolding of the handle with a soft elastic plastic. Preferably, the handle element forms at least part of the surface of the handle. The fact that the surface of the handle is formed from fiber material gives it a pleasant feel.

The fiber material preferably contains cellulose and preferably comprises wood pulp, semi-wood pulp or cellulose. Mechanical pulp is produced by defibration from plant material, in particular wood, and comprises lignocellulose. In half pulp, the lignin content is reduced compared to mechanical pulp. In chemical pulp, the lignin content is almost completely reduced by chemical pulping processes. The fiber material can be obtained, for example, from wood, especially softwood or hardwood, straw, hemp, cotton, flax, bamboo, bagasse and/or kenaf. Preferably, the fiber material may also comprise waste paper. In a preferred embodiment, the fiber material comprises waste paper. Further, the fiber material may comprise rag pulps, which are vegetable fiber pulps derived from textile waste, such as cotton or linen. Preferably, the fiber material does not comprise synthetic fibers. Preferably, the fiber material consists entirely of vegetable raw materials. Preferably, the fiber material comprises fully compostable components.

The fiber material may additionally contain fillers and/or binders. Preferably, chalk is used as filler. Polylactides are preferably used as binders, in particular polylactides obtained from corn starch.

The cleaning element comprises, for example, one or more bristle filaments or soft-elastic cleaning elements, a bristle carrier with bristle filaments or soft-elastic cleaning elements attached to it, or a dental floss filament.

The cleaning element is sheathed at least in sections with the fiber material of the handle element and is thereby connected to the handle element. Accordingly, the cleaning element comprises at least one connecting section via which the connection to the handle element is established. In a preferred embodiment, the handle element is positively connected to the connecting section. In a preferred embodiment, the connecting section of the cleaning element is pretreated to enable better adhesion to the fiber material of the handle element. For example, the surface of the connection section may be roughened prior to connection to the handle element to improve adhesion of the fiber material. In a preferred embodiment, the connecting section has a hydrophilic surface. Preferably, the connecting section is made of an injection molded plastic, preferably polyethylene, polypropylene, polyamide, polyethylene terephthalate and/or polybutylene terephthalate. Polyethylene terephthalate and polybutylene terephthalate are particularly preferred due to their high adhesion compatibility to the fiber material.

In one embodiment, the cleaning element comprises one or more bristle filaments or soft-elastic cleaning elements. The bristle filaments are preferably made of a thermoplastic and are preferably combined into one or more bristle bundles. The soft-elastic cleaning elements are preferably made of an elastomer and are, for example, in the form of nubs or lamellae.

In one embodiment, the bristle filaments or soft elastic cleaning elements are directly attached to the fiber material of the handle element. For example, the bristle filaments are attached to the handle element by anchors embedded in the fiber material of the handle element. Preferably, the anchors are made of metal. The anchors can be, for example, metal plates which are wrapped with the bristle filaments. The anchors can either be pressed into the fiber material of the handle element or overmolded with the fiber material during production of the handle element. The bristle filaments or soft elastic cleaning elements may also be attached to the handle element without anchors. For example, the bristle filaments or soft-elastic cleaning elements can each be overmolded at their attachment-side ends by the fiber material of the handle element and thus be embedded with their attachment-side ends in the fiber material of the bristle carrier. For this purpose, thickenings surrounded by the fiber material are preferably formed at the fastening-side ends of the bristle filaments or soft-elastic cleaning elements.

In an alternative embodiment, the bristle filaments or soft-elastic cleaning elements are attached to a separate bristle carrier. In this embodiment, the cleaning element is in particular a bristle carrier for a toothbrush with bristle filaments or soft-elastic cleaning elements attached to it.

The bristle carrier is preferably made of injection-molded plastic. The bristle carrier can be in the form of a section of a brush head. For example, the bristle carrier is in the form of a relatively thin platelet, which is used primarily for attaching bristle filaments and/or soft-elastic cleaning elements. In this variant, the bristle carrier is partially covered with the fiber material of the handle element to form the complete brush head. The surface of the bristle carrier covered by the fiber material thus serves as a connecting section. An advantage of this variant is a comparatively large contact area between the bristle carrier and the handle element and a reduction in the amount of plastic required for the toothbrush. The bristle carrier can also completely form the brush head. In this variant, no fiber material is used to form the brush head. Instead, the connecting portion by which the bristle carrier is connected to the handle element is provided in the region of the toothbrush neck or handle. The brush head and brush neck thus consist predominantly of the material of the bristle carrier. One advantage of this variant is that the handle element, which is made of fibrous material, does not have to be inserted into the oral cavity and thus cannot be softened by saliva. Another variant is that the bristle carrier is extended to form a handle body, the handle body forming the core of the toothbrush handle and being encased by the fiber material of the handle element.

Bristle filaments and/or soft elastic cleaning elements are attached to the bristle carrier. The bristle filaments and/or soft-elastic cleaning elements protrude from the bristle carrier on at least one side so that they can be used for cleaning the teeth and/or oral mucosa. The bristle filaments are preferably combined into one or more bristle bundles. The bristle filaments are attached to the bristle carrier, for example, by anchors pressed into the material of the bristle carrier. The anchors are preferably made of metal. Metal plates, for example, which are wrapped with the bristle filaments, can serve as anchors. The bristle filaments or soft elastic cleaning elements can also be attached to the bristle carrier without anchors. For example, the bristle filaments or soft-elastic cleaning elements can each be overmolded at their attachment-side ends by the material of the bristle carrier and thus be embedded with their attachment-side ends in the material of the bristle carrier. For this purpose, thickenings are preferably formed at the attachment-side ends of the bristle filaments or soft-elastic cleaning elements, which are overmolded with the material of the bristle carrier. It is also possible for the bristle carrier to have through holes through which bristle filaments or soft-elastic cleaning elements are inserted. In this case, the bristle filaments or the soft-elastic cleaning elements each have thickenings at their fastening-side end, which rest positively against one side of the bristle carrier and prevent the bristle filaments or the soft-elastic cleaning elements from being pulled out of the through-holes.

Preferably, the handle element forms at least part of a toothbrush handle. Preferably, the handle element forms a depression in the area of the toothbrush handle, which serves as a thumb rest. This increases the ergonomics of the cleaning device. The toothbrush handle may be formed entirely from the fiber material, with the connection to the cleaning element occurring only in the region of the toothbrush neck or the toothbrush head. Meanwhile, it is also possible for the toothbrush handle to have a core made of a material other than the fiber material of the handle element. For example, the core of the toothbrush handle may be made of the material of the bristle carrier, which is sheathed by the fiber material to form the handle element. Preferably, this core is formed integrally with the bristle carrier. Preferably, the handle element forms at least part of the surface of the toothbrush handle. By the fact that the surface of the toothbrush handle is formed from fiber material, a pleasant feel is achieved.

In a further embodiment, the cleaning element is a bristle carrier for an interdental cleaning device. In this case, the bristle carrier is preferably designed with a rod-shaped base. The length and diameter of the rod-shaped base are adapted so that the cleaning element can be inserted into the narrow interdental spaces in order to clean the tooth surfaces there. The rod-shaped base can, for example, consist of wires twisted together, in particular metal or plastic wires, or of an injection-molded plastic. In one embodiment, bristle filaments are attached to the rod-shaped base. Preferably, the bristle filaments are combined into one or more bristle bundles. Preferably, the bristle bundles are sandwiched between the wires that are twisted together. The bristle bundles may also be attached to a base of injection molded plastic, for example by overmolding their attachment side ends. In another embodiment, soft elastic cleaning elements are attached to the rod-shaped base. In this case, the rod-shaped base is preferably made of an injection-molded plastic, in particular a soft-elastic plastic. In this embodiment, the soft-elastic cleaning elements may be molded from the material of the rod-shaped base, or they may be molded from a different material and partially overmolded by the material of the rod-shaped base. The bristle filaments and/or the soft-elastic cleaning elements preferably protrude from the rod-shaped base transversely, in particular at right angles, to the longitudinal axis of the rod-shaped base.

In this embodiment, the handle element is preferably rod-shaped and extends in particular in the longitudinal direction of the rod-shaped base of the cleaning element. The length and diameter of the handle element are preferably adapted so that the handle element can be held comfortably and securely between two fingers. The handle element preferably has at least one holding section. In the region of the holding section, the otherwise preferably rod-shaped handle element is flattened, and the holding section is particularly preferably plate-shaped. In this way, the holding section offers a larger gripping surface and can be held securely between the thumb and index finger, for example. Preferably, the holding section consists entirely of the fiber material. Accordingly, the fiber material in the region of the retaining section is preferably not injection-molded around a core made of another material, for example plastic.

In a further embodiment, the cleaning element is a dental floss filament. The dental floss filament preferably comprises one or more filaments, preferably filaments twisted together. The filaments that are twisted together fan out during use and thus provide improved cleaning action. Preferably, the filaments are made of plastic.

The floss thread is attached by one or both of its ends. One or both ends of the floss thread may be directly attached to the fiber material of the handle element. Alternatively, attachment sections of a different material may be provided at one or both ends of the floss filament so that the fiber material is connected to these attachment sections. This allows for a stronger anchoring of the floss filament in the material of the handle element. Preferably, attachment sections in the form of thickenings are provided at one or both ends of the floss filament. These thickenings can be embedded in the material of the handle element to enable stable attachment of the dental floss thread to the handle element. The fastening sections are preferably made of plastic, for example polyethylene, polypropylene, polyamide, polyethylene terephthalate and/or polybutylene terephthalate.

In one embodiment, the cleaning device is a dental floss holder, in particular a so-called dental floss stick or dental fiddle. In this case, the cleaning element comprises a dental floss thread as described above. In this embodiment, the handle element preferably forms two arms between which the floss thread is stretched. Accordingly, the dental floss thread is preferably connected to the handle element at its two ends. It is also possible that the cleaning element comprises a dental floss thread and an additional holding device. The holding device is made of a different material than the handle element, for example plastic. The holding device preferably forms two arms between which the floss thread is stretched. These arms preferably correspond to the above-mentioned fastening sections. In addition, the holding device forms a connecting section which is connected to the handle element.

In the process for manufacturing the cleaning device, the cleaning element is produced by processes known per se. The cleaning element can therefore be used as a pre-produced finished part.

The handle element, on the other hand, is manufactured by injection molding a fiber material. Injection molding of the fiber material takes place in an injection mold provided for this purpose. The fiber material is preferably drawn as granules into an injection molding unit and extruded by temperature and friction to form a melt. The melt is injected into the injection mold. Unlike conventional processes for producing paper or board, in which a dilute suspension of fiber material is used, injection molding preferably uses a melt with a higher proportion of fiber material and thus a higher viscosity.

In a preferred embodiment, the cleaning element is overmolded with the fiber material at least in sections during production of the handle element in order to connect the handle element to the cleaning element. For this purpose, the cleaning element has a connecting section which is inserted into the injection mold for producing the handle element and is overmolded with the fiber material. The production of the handle element and the connection of the handle element to the cleaning element take place simultaneously.

In an alternative embodiment, the handle element is manufactured independently of the cleaning element by injection molding and then connected to the cleaning element. In this embodiment, the handle element is preferably bonded or screwed to the cleaning element. The adhesive used is preferably glue or an acrylate-containing adhesive, preferably a water-based acrylate-containing adhesive.

In a further preferred embodiment, the cleaning device is first overmolded in sections with a plastic to form a connecting section. The plastic used here is preferably polyethylene, polypropylene, polyamide, polyethylene terephthalate and/or polybutylene terephthalate. Polyethylene terephthalate and polybutylene terephthalate are particularly preferred due to their high adhesion compatibility with the fiber material. This connecting section is preferably inserted into the injection mold for producing the handle element in a second step and is overmolded with the fiber material. Alternatively, the connecting section can be bonded to a separately manufactured handle element as described above.

In a preferred embodiment, the handle element is positively connected to the connecting section provided on the cleaning element, in particular the connecting section is overmolded with the fiber material in such a way that a positive connection results.

In a preferred embodiment, the connecting section provided on the cleaning element is pretreated to achieve better adhesion of the handle element. Preferably, the connecting section is mechanically roughened and/or provided with an adhesion promoter.

The invention claimed is:

1. A toothbrush for oral hygiene comprising a bristle carrier and a handle element connected to the bristle carrier with a glue, wherein the handle element is made of an injection-molded fiber material, and the fiber material comprises wood pulp and consists of fully compostable components, wherein bristle filaments and/or soft elastic cleaning elements are attached to the bristle carrier, and wherein the bristle carrier is extended to form a handle body, the handle body forming the core of the toothbrush handle and being encased by the fiber material of the handle element.

2. The toothbrush according to claim 1, wherein the fiber material comprises cellulose.

3. The toothbrush according to claim 2, wherein the fiber material comprises at least one of mechanical pulp, semi-chemical pulp or chemical pulp.

4. The toothbrush according to claim 2, wherein the fiber material is obtained from at least one of wood, straw, hemp, cotton, flax, bamboo, bagasse or kenaf.

5. An interdental cleaning device for oral hygiene comprising a rod-shaped base and a handle element connected to the rod-shaped base, wherein the handle element is made of an injection-molded fiber material, and the fiber material comprises wood pulp and consists of fully compostable components, wherein the rod-shaped base consists of wires twisted together, wherein bristles and/or soft-elastic cleaning elements protrude from the rod-shaped base transversely to the longitudinal direction of the rod-shaped base, and wherein the rod-shaped base and the handle element are connected by overmolding the rod-shaped base with the fiber material of the handle element, to produce the handle element and the connection of the handle element to the cleaning element simultaneously.

6. The interdental cleaning device according to claim 5, wherein the fiber material comprises cellulose.

7. The interdental cleaning device according to claim 6, wherein the fiber material comprises at least one of mechanical pulp, semi-chemical pulp or chemical pulp.

8. The interdental cleaning device according to claim 6, wherein the fiber material is obtained from at least one of wood, straw, hemp, cotton, flax, bamboo, bagasse or kenaf.

9. The interdental cleaning device according to claim 5, wherein the rod-shaped base and the handle element are connected with glue.

10. The interdental cleaning device according to claim 5, wherein in a first step the rod-shaped base is provided consisting of the wires twisted together, and in a second step the handle is attached to the twisted wires by overmolding, by which the handle is formed.

* * * * *